US007373921B2

(12) United States Patent
Geyer et al.

(10) Patent No.: US 7,373,921 B2
(45) Date of Patent: May 20, 2008

(54) MANUALLY GUIDED IMPLEMENT

(75) Inventors: Klaus Geyer, Sulzbach (DE); Lars Bergmann, Walblingen (DE); Klaus-Martin Uhl, Plochingen (DE); Stefan Anspann, Regensburg (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 11/774,767

(22) Filed: Jul. 9, 2007

(65) Prior Publication Data

US 2008/0006240 A1 Jan. 10, 2008

(30) Foreign Application Priority Data

Jul. 8, 2006 (DE) ..... 10 2006 031 695

(51) Int. Cl.
*F02D 31/00* (2006.01)

(52) U.S. Cl. ..... 123/376; 123/400

(58) Field of Classification Search ..... 123/363, 123/376, 377, 400

See application file for complete search history.

(56) References Cited

U.S. PATENT DOCUMENTS 6,666,187 B2 * 12/2003 Dahlberg et al. ..... 123/398
7,000,591 B1 * 2/2006 Raetzman et al. ..... 123/376
7,165,532 B2 * 1/2007 Steffes et al. ..... 123/376
2003/0029418 A1 * 2/2003 Deschamps et al. ..... 123/376
2006/0130809 A1 * 6/2006 Wetor et al. ..... 123/376
2007/0169743 A1 * 7/2007 Kobayashi et al. ..... 123/352

* cited by examiner

*Primary Examiner*—Erick Solis
(74) *Attorney, Agent, or Firm*—Robert W. Becker; Robert W. Becker & Assoc.

(57) ABSTRACT

A manually guided implement having a motor unit and a tool unit driven by the motor unit. The motor unit includes an internal combustion engine having a carburetor, and a butterfly valve. A throttle acts upon the butterfly valve via a transfer mechanism. A speed regulator is provided for the internal combustion engine. The transfer mechanism is divided into two transfer portions. The speed regulator is a mechanical speed regulator and is disposed between two transfer portions such that the throttle, via the first transfer portion associated therewith, as well as the speed regulator together act upon the second transfer portion, which is associated with the butterfly valve, whereby as its speed increases, the speed regulator effects a closing of the butterfly valve.

22 Claims, 6 Drawing Sheets

MANUALLY GUIDED IMPLEMENT

BACKGROUND OF THE INVENTION

The present invention relates to a manually guided or portable implement having a motor unit and a tool unit driven by the motor unit.

Manually guided implements, such as power tillers, brushcutters, trimmers, pruners, chain saws or the like, must be easy to handle. For this purpose, a compact construction and a low weight are desirable. To nevertheless be able to achieve a high output with a small and lightweight combustion engine, it is necessary, among other features, to have a high operational speed. During operation, this results in a high generation of noise, which must not exceed a certain limiting value.

As measures to limit the generation of noise, in addition to mufflers and other means, speed regulators are also known that when low load is present at the driven tool prevent an excessive speeding-up of the internal combustion engine. During operation, the tool that is driven by the internal combustion engine is subjected to fluctuating loads, which cannot always be absorbed by the user by means of an adaptation of the throttle position. In particular at full throttle, and suddenly declining operational load, the speed regulator prevents an excessive increase in speed. In addition to limiting the generation of noise, the tool and the drive train are also protected against overloading caused by speed.

To limit or regulate the speed, various arrangements are known according to which an adjustment of the choke valve, the actuation of a speed-regulating valve in the carburetor, an ignition influence or the like is provided. To the extent that such a speed regulator interferes in the operation of the internal combustion engine, the result is a disadvantageous influence upon the mixture or exhaust gas formation as well as upon the running conditions of the internal combustion engine. For different implements having different tools, different threshold speeds can be required, which necessitate an adaptation of the speed regulator to the respective implement or application thereof. A higher construction and development expenditure is associated therewith.

It is therefore an object of the present invention to further develop an implement of the aforementioned general type in such a way that a straightforward and reliable speed regulation is possible under different operating conditions.

BRIEF DESCRIPTION OF THE DRAWINGS

This object, and other objects and advantages of the present application, will appear more clearly from the following specification in conjunction with the accompanying schematic drawings, in which.

SUMMARY OF THE INVENTION

Figure 1:
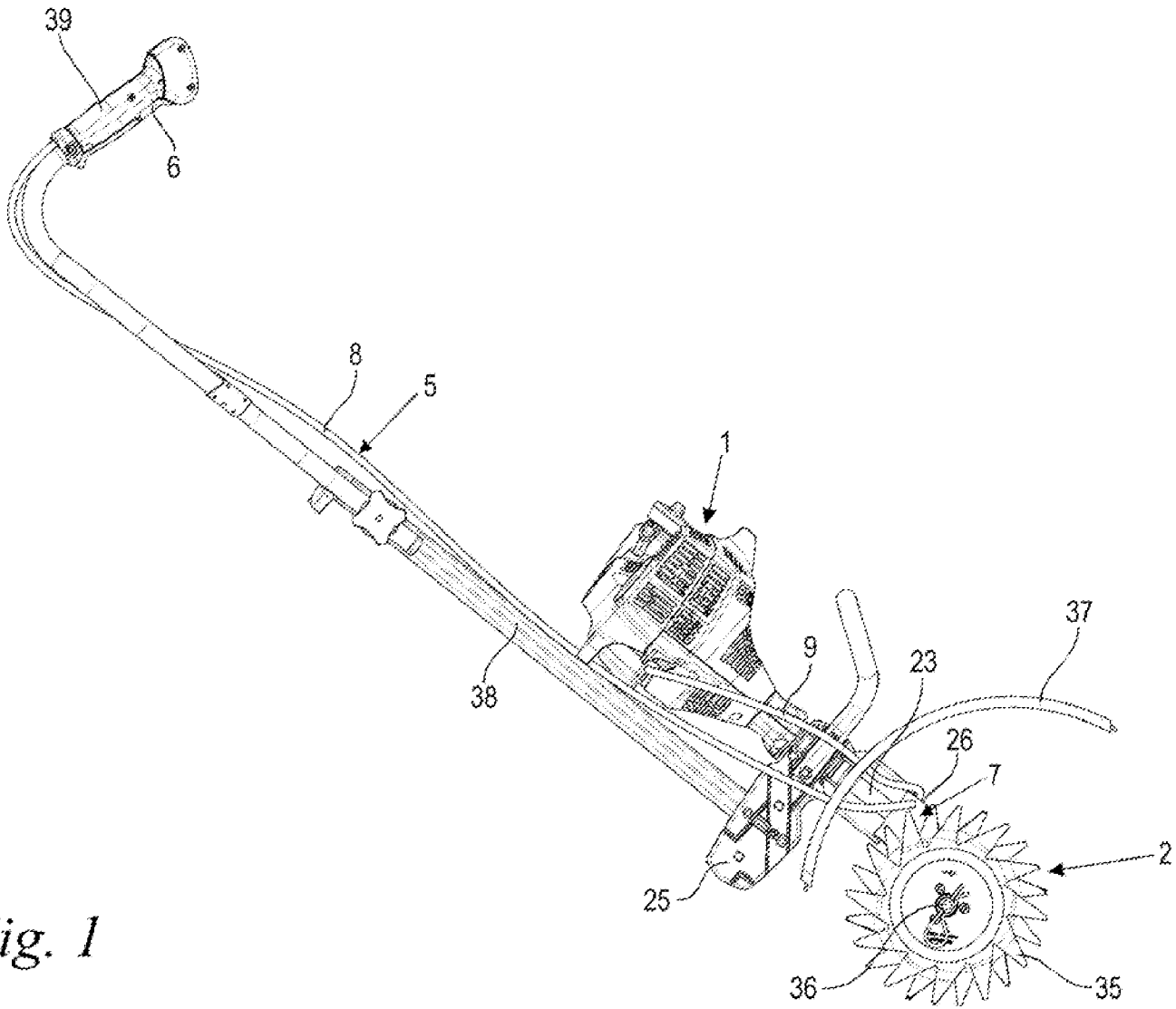
FIG. 1 is a side view showing an exemplary embodiment of an implement pursuant to the present invention, here as a power tiller, having an exchangeable motor and/or tool unit and a speed regulator associated with the tool unit.

The present application provides a manually guided implement having a motor unit and a tool unit driven by the motor unit, whereby the motor unit includes an internal combustion engine having a carburetor, and a butterfly valve disposed in the carburetor for controlling the power of the internal combustion engine. A gas throttle actuated by the user acts upon the butterfly valve via a transfer mechanism, for example in the form of a Bowden cable or a linkage. The transfer mechanism is divided into two transfer portions, whereby a first transfer portion is associated with the throttle, and a second transfer portion is associated with the butterfly valve. The speed regulator is embodied as a mechanical speed regulator and is disposed between the two transfer portions in such a way that the throttle, together with the first transfer portion associated therewith, as well as the speed regulator together act upon the second transfer portion that is associated with the butterfly valve, whereby the speed regulator, as its speed increases, effects a closing of the butterfly valve.

The mechanical configuration of the speed regulator has a simple construction and is reliable. A characteristic curve adapted to the respective conditions, and hence its effect for setting the desired speed characteristic, can be set with little expenditure. Throttle and speed regulator work together on the same butterfly valve. A speed regulation corresponds in effect to a reduced gas feed, with a correspondingly reduced generation of noise. Also in the speed-regulated state, the internal combustion engine carries out a clean combustion, so that it's running and exhaust gas conditions are not adversely affected. With the throttle, the user can preselect any desired output power. The power setting selected by the user is not adversely affected during normal operation, with this setting being overridden upon engagement of the speed regulator merely by resetting of the butterfly valve.

The arrangement itself has a straightforward construction. Carburetor and ignition require no structural overhaul. Different speed regulators and engines can be exchanged with one another, thus facilitating adaptation to different noise and speed requirements.

The speed regulator can be embodied in such a way that the user prescribes via the throttle a desired operational speed that is kept at least approximately constant by the speed regulator independent of load fluctuations. Pursuant to a preferred further development, the speed regulator is a speed limiter that above a prescribed threshold speed effects a closing of the butterfly valve. Excessive speed and excessive development of noise are prevented. Below a threshold speed, the speed regulator is not effective. In such a case, by means of the throttle the user can set any desired motor output or speed.

It can be expedient for the throttle, with the pertaining first transfer portion, and the speed regulator to be connected essentially rigidly in series. The user setting of the throttle is hereby permanently overridden by the regulating distance or travel of the speed regulator. Pursuant to an advantageous further development, the speed regulator, at least relative to a closing direction of the butterfly valve, is essentially rigidly connected with the butterfly valve via the second transfer portion, whereby the throttle, together with the pertaining first transfer portion, is coupled to the second transfer portion via an in particular biased elastic spring device. The coupling of the speed regulator to the butterfly valve, which is rigid in the closing direction, ensures that upon engagement of the speed regulator, its regulating travel acts upon the throttle valve in a closing manner independent of the position of the throttle. A speed reduction or limiting is effected exclusively as a function of the actual speed of the internal combustion engine without influence of the actual throttle position. Below the threshold speed, the speed regulator does not override the user-selected throttle position. The elastic coupling to the second transfer portion enables a mechanical series connection of throttle and speed regulator. By means of the selection of the spring biasing, the regulation characteristic of the speed regulator, as well as its coupling or uncoupling characteristic to the throttle or the first transfer portion thereof, can also be set.

In a preferred embodiment, for this purpose the second transfer portion includes a pivotable coupling shaft on which the speed regulator engages. The first transfer portion includes a coupling lever that is pivotably mounted on the coupling shaft. The coupling shaft and the coupling lever are connected to one another in the pivot direction by the spring device, which is in particular embodied as a torsion spring. A compact and simple assembly as a coupling device is formed in which the regulating travel prescribed by the user via the throttle, and the regulation travel of the mechanical speed regulator, are joined together and from there are conveyed together to the butterfly valve. The coaxial manner of construction is at least approximately free of play. The spring device, which is in particular embodied as a torsion spring, can have a flat spring characteristic, in other words is softer than the return spring of the throttle, as a result of which during normal operation the actuation force that is to be applied by the user to the throttle remains at least nearly uninfluenced.

Pursuant to an expedient embodiment, the speed regulator includes a regulating shaft that is driven by the internal combustion engine and has at least one, in particular two, oppositely disposed centrifugal weights, whereby the centrifugal weight is mounted so as to be pivotable in the radial direction and acts upon means for producing an axial regulation movement. The pivotable mounting of the centrifugal weights enables the setting of a non-linear, in particular progressive characteristic curve. In so doing, it is possible with simple means to ensure that the speed regulator noticeably engages only above the prescribed threshold speed, whereby below that speed it does not influence the throttle position selected by the user. The conversion of the pivoting movement of the centrifugal weights into an axial regulation movement is preferably formed by a regulating sleeve that is disposed on the regulating shaft and is axially displaceable.

The centrifugal weight is advantageously pivotably mounted about a pivot axis that is in particular disposed tangential relative to an axis of rotation of the regulating shaft, whereby a mass center of the centrifugal weight is disposed within the regulating range radially inwardly of the pivot axis. In this connection, relative to the radial centrifugal direction, the mass center has a lever arm relative to the pivot axis. The centrifugal force, in conjunction with the lever arm, exerts a pivot moment upon the centrifugal force about the pivot axis. As a consequence of the radially inward arrangement of the mass center, this lever arm increases with increasing deflection of the centrifugal weight, as a result of which the deflecting moment becomes greater. A progressive regulation characteristic curve results.

With previously known mechanical speed regulators the pivot axis of the centrifugal bodies is disposed close to the axis of rotation of the regulator, while the mass centers of the centrifugal bodies are disposed radially outwardly therefrom. Although the centrifugal force acting upon the mass bodies increases quadratically as the speed increases, this effect is compensated for by a reduction of the effective lever arm as deflection increases. There results a degressive characteristic curve, that at the beginning of the regulation range rises steeply as the speed increases, but then approximates a relatively constant value as the speed continues to rise. The flat regulation characteristic of the state of the art that is flat in the upper speed portion of the regulation range effects a slow and overall stable regulation of the regulator. Fluctuations in speed have less of an influence upon the position of the butterfly valve. As a result, it is not possible to entirely close the butterfly valve with conventional mechanical speed regulators.

However, in many applications, especially with brushcutters or the like, a complete closing of the butterfly valve by the speed regulator may be necessary. At higher speeds, at which tar example the brushcutter operates, spontaneous ignition, the so-called incandescent ignition, can result due to residual gas essence in the cylinder or due to glowing residues. To the extent that an ignition disconnection is dispensed with, a speed regulation is then possible only by a more or less complete closing of the butterfly valve. This is achieved by the appropriate progressive regulation characteristic curve in that the mass centers of the centrifugal weights are disposed radially inwardly of the pivot axis.

With different motor driven implements, it can also be expedient to use different tools on the same implement. For example, a brushcutter can be operated with a mowing filament, or also with a metal thicket blade. Depending upon the tool selected, the same motor must apply different drive moments. In order to enable an effective speed regulation for such varying drive moments with the same speed regulator, a regulating range is required that preferably encompasses the entire useable butterfly valve angle range between and including, for example, 15° for idling and 90° for full throttle. This is achieved by the progressive characteristic curve as a consequence of the radially outwardly disposed pivot axes and the mass centers of the centrifugal weights disposed radially inwardly thereof.

Pursuant to a preferred further development, the means for producing the axial regulation movement act upon a pivot lever, whereby preferably a pivot axis of the pivot lever is disposed essentially perpendicular to an axis of rotation of the regulating shaft. With little space requirement, the pivot lever can be guided, for example, through a housing wall, and in the region of its pivot axis enables a reliable sealing relative to oil and dirt. By eliminating a linear or axial control movement, leaks are avoided in this region. The arrangement of the pivot axis perpendicular to the axis of rotation of the regulating shaft enables a compact construction. To the extent that the crankshaft of the internal combustion engine is provided as the regulating shaft, the pivot lever can be guided directly in a direction toward the carburetor, resulting in a short transfer of force that is free of play. Centrifugal clutch, ignition and other elements driven directly by the crankshaft are spatially avoided in a space-saving manner.

The arrangement comprised of the centrifugal weights and the means for producing the axial regulation movement is advantageously disposed in a closed regulation chamber that is in particular provided with a lubricant, whereby the pivot lever is guided out of the regulation chamber in the region of its pivot axis, and on the outside acts on the second transfer portion of the transfer mechanism to the carburetor. The regulation chamber can be provided in a gear mechanism housing or in a crankcase. An independent regulation chamber can also be expedient that is in fluidic communication with, for example, the crankcase of the two-cycle internal combustion engine. A permanent, nearly maintenance-free lubrication of the speed regulator is ensured. Its kinematic connection to the second transfer portion is disposed externally of the regulation chamber, and is thus freely accessible. A coupling and uncoupling, for example to the motor unit and the tool unit, and also adjustments, are simplified.

Pursuant to a preferred embodiment, the speed regulator is disposed in the tool unit. This allows many variation possibilities for adapting the set maximum speed. In particular, independently of the motor used, the speed of a suitable regulating shaft in the tool unit can form a reference parameter for the regulation characteristic. For example, with so-called "multi-purpose implements", where exchangeable tool units are connected with a respective base motor unit, the speed regulator integrated into the tool unit is exchanged along therewith. Without the need for further adjustments, each individual exchangeable tool unit is associated with a respective specific speed regulator that is adapted to the specific operating characteristic of the associated tool. Along with the exchange of the tool unit, there is automatically effected an adaptation of the maximum motor speed without requiring adjustments. In addition to the mechanical connection between the motor unit and the tool unit it is merely necessary to release or establish the operative connection of the second transfer portion between the speed regulator upon exchange. This can occur by simple attachment or detachment of a Bowden cable. Further activities on the part of the user upon exchange are not necessary.

Pursuant to an expedient further development, the tool unit has a tool gear mechanism, whereby the speed regulator is disposed in the tool gear mechanism of the tool unit. Depending upon the respective step-down or step-up in the gear mechanism, various reference speeds are available for a suitable regulation characteristic. At the same time, the regulator can be connected to the lubricant system of the tool gear mechanism.

Alternatively, it can be expedient to dispose the speed regulator in a supporting housing of the tool unit. In an appropriate construction, a guide tube having a transfer shaft extending therein is disposed between the motor unit and the tool unit, whereby the transfer shaft is guided through the supporting housing of the tool unit to the tool gear mechanism. The supporting housing serves, for example, for the connection of the motor unit, the guide tube, and a carrier member for the tool unit, for handles, control elements, or the like. By accommodating the speed regulator in the supporting housing, the tool gear mechanism can remain unchanged. No additional installation space is required there. In the region of the supporting housing, the installation space is not critical and simplifies the accommodation of the speed regulator. Moreover, a spatial proximity of the supporting housing, with the speed regulator disposed therein, exists relative to the motor unit, which simplifies a short, rigid connection that is free of play via the second transfer portion.

Pursuant to an expedient alternative, the speed regulator is disposed within a crankcase on a crankshaft of the internal combustion engine, which is embodied in particular as a loss-lubricated, preferably two-cycle engine. In this connection, the speed regulator is advantageously disposed in the axial direction of the crankshaft between a crank web, especially between a crankshaft bearing disposed beyond the crank web, and a centrifugal clutch that is disposed on the crankshaft. The oil-containing fuel/air mixture possibly penetrates through the open crankshaft bearing, flows around the speed regulator, and leads to a reliable, permanent lubrication. The arrangement relative to the centrifugal clutch enables a compact construction as well as an immediate spatial proximity to the carburetor.

Pursuant to an expedient further development, a lever arm of the pivot lever disposed externally of the crankcase is guided essentially parallel to the crankshaft and inwardly in the direction toward the center of the crankshaft and below the carburetor. The installation space of the centrifugal clutch, and of the tool unit connected thereto, is not adversely affected. At the same time, the spatial distance of the lever arm of the pivot lever to the carburetor is shortened, thus directly simplifying the transfer of force.

The pivot lever is advantageously connected via a connecting rod with an actuating lever of the coupling shaft, and in this connection is suspended in a slot of the actuating lever. The coupling lever is advantageously embodied as a butterfly valve shaft that supports the butterfly valve. With few components, a high degree of integration is formed that in addition to low manufacturing costs enables a high regulation precision. The suspension of the connecting rod in a slot of the actuating lever produces a dead travel of the speed regulator. This ensures that the speed regulator engages only above a prescribed speed. During normal, not regulated operation, an uncoupling results between throttle and speed regulator, so that the speed regulator does not adversely affect a normal actuation of the throttle.

Pursuant to a preferred further development, the coupling lever, for the engagement of the first transfer portion, and the actuating lever, for the engagement of the speed regulator, are disposed on opposite sides of the carburetor relative to the axial direction of the butterfly valve shaft. The transfer of force from speed regulator to the actuating lever, and the transfer of force from the throttle to the coupling lever, are spatially separated from one another. The construction saves space and permits a kinematically clean guidance of the force-transferring regulation elements that is free of play.

Further specific features of the present invention will be described in detail subsequently.

DESCRIPTION OF SPECIFIC EMBODIMENTS

Referring now to the drawings in detail, the side view of FIG. 1 shows an inventively embodied, manually-guided implement, here as a power tiller. However, the implement could also be a brushcutter, trimmer, pole pruner, or the like.

The implement includes a motor unit 1 having an internal combustion engine, which is not illustrated in greater detail, disposed therein; the implement also includes a tool unit 2 that is driven by the motor unit 1.

The tool unit 2 includes a supporting housing 25, a tool gear mechanism 26, a tilling tool 35, a protective shield 37 for the tilling tool 35, and a carrier member 38 having a handle or hand grip 39 disposed thereon.

Figure 3:
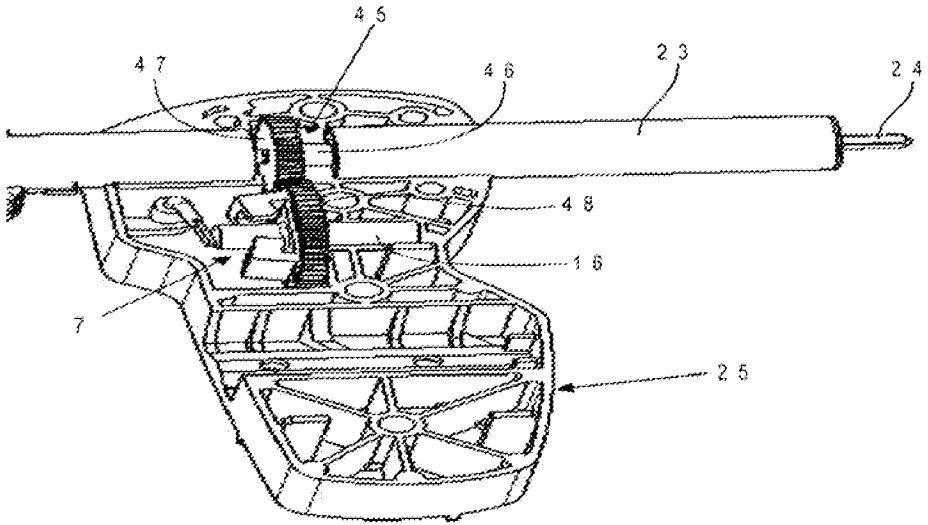
FIG. 3 is an open perspective view of the supporting housing to of the power tiller of FIG. 1 showing a mechanical speed regulator disposed therein.

Guided through the supporting housing 25 is a guide tube 23 having an inwardly disposed transfer shaft 24, which is illustrated in FIG. 3. The guide tube 23 is secured to the supporting housing 25, to the motor unit 1, as well as to the tool gear mechanism 26, and establishes a mechanically supporting connection between them. Furthermore, the carrier member 38, with the hand grip 39, is secured in the supporting housing 25, according to which the carrier member 38, the supporting housing 25, the guide tube 23, and the tool gear mechanism 26 form a mechanically cohesive unit.

The motor unit 1 is embodied as a so-called "multi-motor", and forms an independently operable module. The motor unit 1 is replaceably or exchangeably secured to the guide tube 23 of the tool unit 2 in a modular manner, and is provided for exchangeable use on other tool units that might deviate in construction.

During operation, the motor unit 1 drives the tilling tool 35 by means of the transfer shaft 24 that is illustrated in FIG. 3. For this purpose, the speed of the transfer shaft 24 is converted in the tool gear mechanism 26 with regard to speed and course of the axis of rotation: the titling tool 35 is rotatably driven about a tool shaft 36, the axis of rotation of which extends transverse and perpendicular to the axis of rotation of the transfer shaft 24. In this connection, the speed of the tool shaft 36 is reduced relative to the speed of the transfer shaft 24 (FIG. 3).

Figure 2:
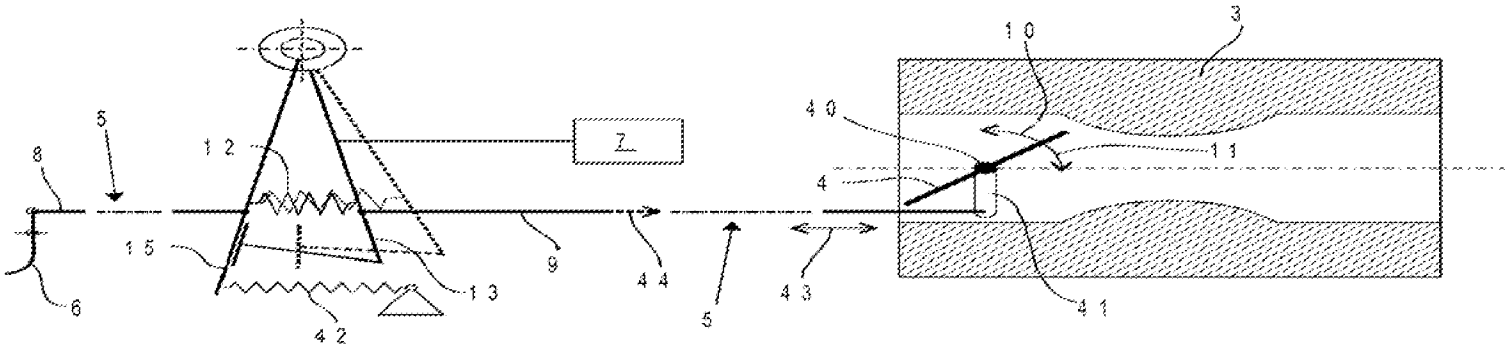
FIG. 2 illustrates the principle of the mechanical force transfer from the throttle and from the mechanical speed regulator relative to one another as well as to the butterfly valve of the carburetor.

To supply a fuel/air mixture to the internal combustion engine of the motor unit 1, a carburetor 3 is provided that is disposed in the motor unit 1 and is schematically illustrated in FIG. 2. A pivotably mounted butterfly valve 4 (FIGS. 2, 6, 7) is disposed in the carburetor 3 for controlling the power of the internal combustion engine. Disposed on the underside of the hand grip 39 is a gas throttle 6 that is to be operated by the user and that acts upon the butterfly valve 4 by means of a transfer mechanism 5.

The implement is provided with a mechanical speed regulator 7, the particulars of which will be described in greater detail subsequently, and which in the embodiment of FIG. 1 is disposed in the tool unit 2, in particular in the tool gear mechanism 26.

The transfer mechanism 5 from the throttle 6 to the butterfly valve 4 (FIG. 2) is embodied as a two-part Bowden cable in the embodiment of FIG. 1. However, a multi-part linkage or the like can also be expedient. The transfer mechanism 5 is divided into two transfer portions 8, 9. The first transfer portion 8, which is embodied as a Bowden cable, extends from the throttle 6 to the speed regulator 7 in the tool unit 2. From there, a second transfer portion 9, similarly in the form of a Bowden cable, extends to the motor unit 1 where it is in operative connection with the butterfly valve 4 (FIG. 2).

The speed regulator 7 is in a mechanical connection relative to a suitably rotating shaft of the tool unit 2. This can be the tool shaft 36 or the transfer shaft 24 (FIG. 3). The respective speed of the aforementioned shaft, or also the speed of some other suitable shaft of the tool unit 2, serves as a drive or reference parameter of the speed regulator 7 for regulating the speed or motor power. By disposing the speed regulator 7 in the tool unit 2, this reference speed can be adapted to the specific requirements of a respective exchangeable tool unit 2. Different tool units 2 can have various, preset reference speeds with which the exchangeable motor unit 1 is to be controlled. The same motor unit 1 experiences different, adapted speed characteristics or threshold speeds on different tool units 2.

A junction or point of connection between the two transfer portions 8, 9 is provided on the speed regulator 7 in the tool unit 2. When exchanging the motor unit 1, in addition to the mechanical connection it is merely necessary to separate or establish the operative connection of the second transfer portion 9 between the motor unit 1 and the tool unit 2. After successful connection of the motor unit 1, the latter is subjected to the influence of the speed regulator 7 that is associated with the respective tool unit 2.

A diagrammatical functional view of the control of the butterfly valve 4 via the throttle 6 and the speed regulator 7 is illustrated in FIG. 2. The butterfly valve 4 is pivotably mounted in an intake channel of the carburetor 3 via a butterfly valve shaft 40, and is illustrated in the half-open state. Proceeding from this half-open state, the butterfly valve 4 is pivotable in a closing direction in conformity with the arrow 10, and in an opening direction in conformity with the arrow 11. For actuation of the pivoting movement, a butterfly valve lever 41 is disposed on the butterfly valve shaft 40; the second transfer portion 9 of the transfer mechanism 5 is attached to the butterfly valve lever 41. At the opposite end the second transfer portion 9 is connected to an actuating lever 13 of a coupling device, with the speed regulator 7 also engaging the actuating lever 13. The coupling device furthermore includes a coupling lever 15, which is pivotable coaxially relative to the actuating lever 13 and on which the throttle 6 acts by means of the first transfer portion 8 of the transfer mechanism 5.

The coupling lever 15 and the actuating lever 13 are connected to one another by means of an interposed spring device 12. This spring device is elastically biased in such a way that the actuating lever 13 rests against the coupling lever 15 via an abutment or stop. The biasing force of the spring device 12 in the tensioning direction is such that during normal operation a rigid connection is established between the actuating lever 13 and the coupling lever 15. When gas is fed via the throttle 6, a tensioning force is applied in the first transfer portion 8; this tensioning force is introduced essentially rigidly, via the coupling lever 15, the spring device 12, and the actuating lever 13 into the second transfer portion 9, and from there is transferred also essentially rigidly to the butterfly valve 4. The transferred tensioning force effects a pivoting of the butterfly valve 4 in the opening direction 11. For this purpose, the biasing force of a return spring 42 that acts on the coupling lever 15 must be overcome. Upon release of the throttle 6, and relaxing of the tensioning force in the transfer mechanism 5, the return spring 42 effects an automatic closing of the butterfly valve 4 in the closing direction 10. The return spring 42 of the butterfly valve 4 is stiffer than the spring device 12, in other words, it has a steeper spring characteristic. The spring device 12, which is considerably softer in comparison thereto, thus has an only low return effect upon the actuation forces on the throttle 6.

The speed regulator 7, at least relative to the closing direction 10 of the butterfly valve 4, is connected essentially rigidly to the actuating lever 13 and thereby together with the second transfer portion 9 to the butterfly valve 4. With a given position of the throttle 6 and of the coupling lever 15, and if a preset threshold speed is exceeded, the speed regulator 7 holds the actuating lever 13 against the biasing force of the spring device 12. As a result, independent of the position of the first transfer portion 8, the second transfer portion 9 is moved in the direction of the arrow 44 and pivots the butterfly valve 4 in the closing direction 10. The power of the internal combustion engine is reduced. An excessive increase in speed, or an exceeding of a desired maximum speed, is prevented. The speed regulator 7 is thus a speed limiter that above a prescribed threshold speed effects a closing of the butterfly valve 4. The coupling of the speed regulator 7, in particular via the spring characteristic or spring biasing of the spring device 12, can be set in such a way that even at different, especially low, speeds prescribed by the user the adjustment of the throttle 6 can be kept constant. In so doing, the speed regulator 7 can act upon the butterfly valve 4 not only in the closing direction 10 but also in the opening direction 11.

By means of the illustrated coupling device, not only the speed regulator 7 but also the throttle 6, along with the first transfer portion 8 associated with it, together act via the second transfer portion 9 upon the butterfly valve 4 in such a way that during normal operation an adjustment of the throttle 6 leads to a displacement path of the second transfer portion 9 in accordance with the double arrow 43. Accordingly, an opening of the butterfly valve 4 in the opening direction 11, or a closing in the closing direction 10, is effected. If the speed increases exceedingly, especially in the range of a preset threshold speed, or beyond it, the speed regulator 7 engages and effects a closing of the butterfly valve 4 in the closing direction 10.

FIG. 3 shows a variant of the invention of FIG. 1, according to which a speed regulator 7 is disposed in the supporting housing 25, which is illustrated open. The guide tube 23, with a transfer shaft 24 that is coaxially rotatably disposed therein and is driven by the motor unit 1 (FIG. 1), is guided through the supporting housing 25. The guide tube 23 is comprised of two parts, forming a division location 45, while to the transfer shaft 24 continuously bridges the division location 45. A first gear wheel 47 is fixedly secured to a portion 46 of the transfer shaft 24 that is exposed in the division location 45. A second gear wheel 48 is disposed on a regulating shaft 16 that is mounted so as to be axially parallel to the transfer shaft 24; the second gear wheel 48 meshes with the first gear wheel 47. The mechanical speed regulator 7 forms a structural unit with the regulating shaft 16 and the second gear wheel 48. By selecting a different number of teeth for the two gear wheels 47 and 48, a suitable speed of the regulating shaft 16, i.e. of the speed regulator 7, and hence a suitable regulation characteristic, can be set. It can also be expedient to dispose the speed regulator 7 directly on the transfer shaft 24.

Figure 4:
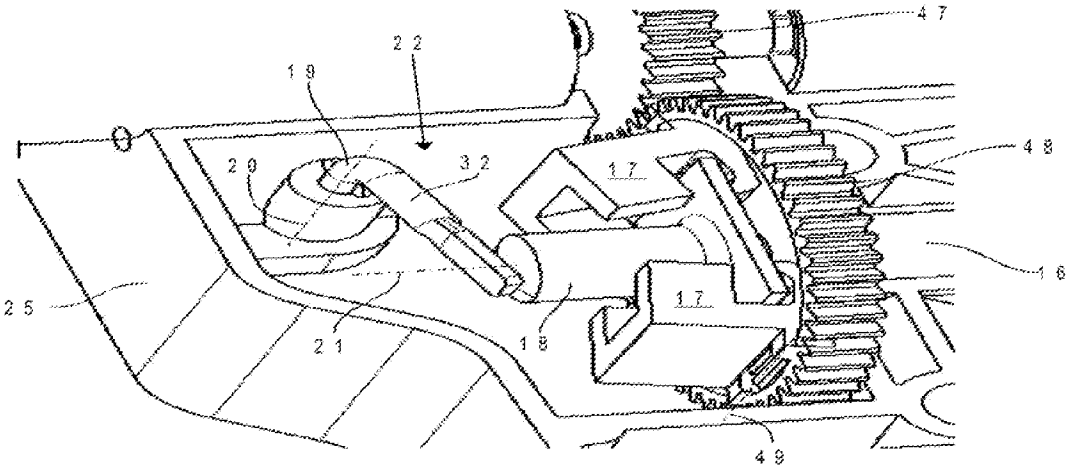
FIG. 4 is an enlarged detailed view of the arrangement of FIG. 3 showing details of the speed regulator at standstill or at low speeds.
Figure 5:
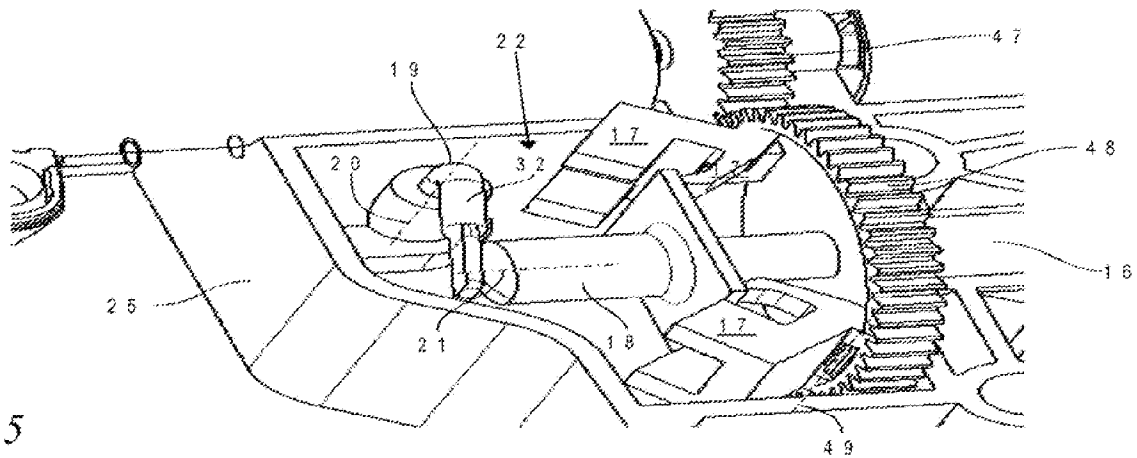
FIG. 5 shows the arrangement of FIG. 4 at increased speed.

Further details of the speed regulator, driven by the transfer shaft 24, in the supporting housing 25 pursuant to FIG. 3 are described in greater detail in conjunction with FIGS. 4 and 5. Accordingly, relative to an axis of rotation 21 of the regulating shaft 16 two diametrically oppositely disposed centrifugal weights 17 are provided that are pivotably mounted in the radial direction relative to the axis of rotation 21. Pursuant to FIG. 4, the centrifugal weights 17 are in a position of rest, i.e. are in a pivot position that corresponds to a low speed or to an operating speed of the drive motor. For this purpose, the centrifugal weights 17 are pivotably mounted in the second gear reel 48 via tangentially extending pivot axes 49, and are inclined radially inwardly.

The centrifugal weights 17, as a function of the speed or the centrifugal forces that result therefrom and act upon them, act on means for producing an axial regulation movement. In the embodiment of FIGS. 3 to 5, this means is formed by a regulating sleeve 18 that is disposed on the regulating shaft 16 and is axially displaceable.

Also provided is a pivot lever 19 that is mounted in the supporting housing 25 so as to be pivotable about a pivot axis 20. The pivot axis 20 of the pivot lever 19 is disposed essentially perpendicular to and laterally offset from the axis of rotation 21 of the regulating shaft 16. In the interior of the supporting housing 25, the pivot lever 19 is provided with a lever arm 32 that projects approximately at right angles, with a free end of the lever arm 32 resting against an end face of the regulating sleeve 18. An axial displacement stroke of the regulating sleeve 18 is transferred to the lever arm 32 and produces a pivoting of the pivot lever 19 about the pivot axis 20.

Such a pivoted position of the pivot lever 19 is shown in FIG. 5. Upon reaching or exceeding a threshold speed, the centrifugal weights 17 are pivoted radially outwardly about their pivot axes 49 and displace the regulating sleeve 18, via inwardly disposed claws, in the direction of the axis of rotation 21 and onto the lever arm 32 of the pivot lever 19. In so doings the pivot lever 19, with its lever arm 32, is pivoted about its pivot axis 20 by the gear wheel 48 in an advancing or progressive manner.

The illustration of FIGS. 4 and 5 also shows that the arrangement comprised of the centrifugal weights 17 and the means for producing the axial regulation movement is disposed in a closed regulation chamber 22. The closed regulation chamber 22 is formed by the interior of the supporting housing 25, that can also be the interior of the tool gear mechanism 26 (FIG. 1). The regulation chamber 22 is provided with a lubricant such as oil or grease for lubrication of the pivot lever 19, the pivotably movable centrifugal weights 17, and the gear wheels 47, 48.

Figure 6:
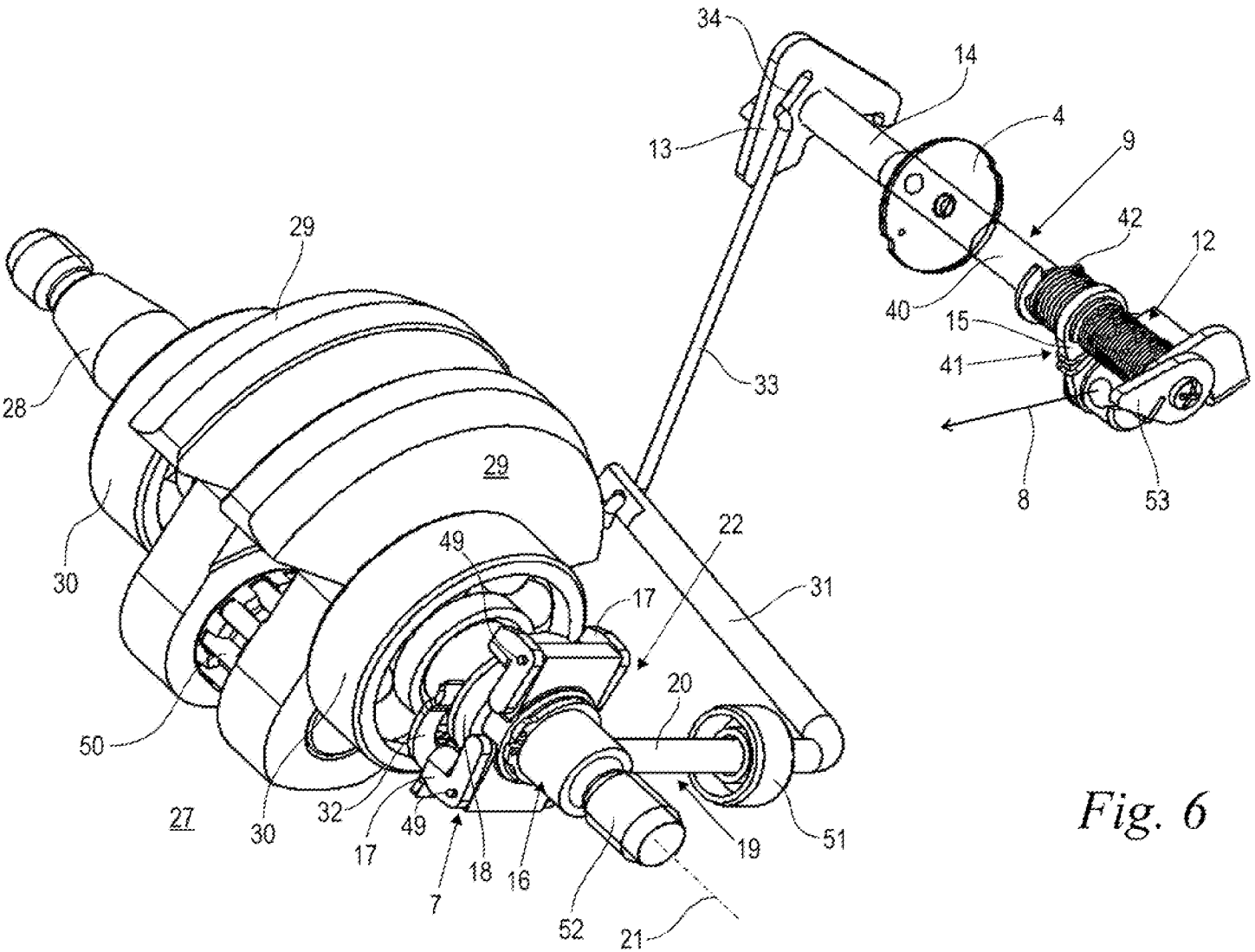
FIG. 6 shows a variant of the regulator arrangement positioned on the crankshaft with details of the force transfer to the butterfly valve shaft.
Figure 7:
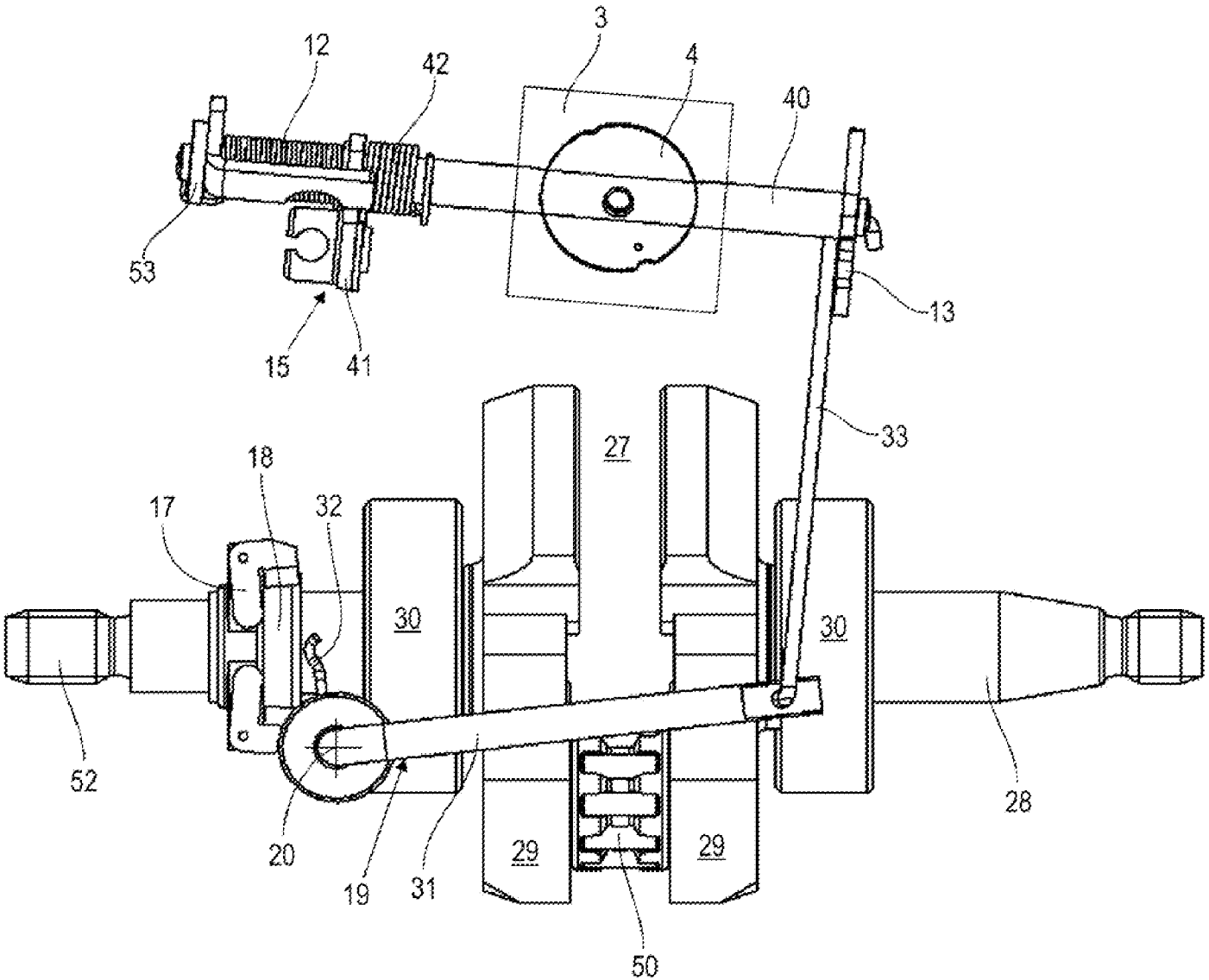
FIG. 7 is a rear view of the arrangement of FIG. 6 with further details of the configuration of the speed regulator, its force transfer to the butterfly valve shaft, and of the coupling of the coupling lever.

In the region of its pivot axis 20, the pivot lever 19 is guided out of the regulation chamber 22. On the outer side of the supporting housing 25, a coupling of the pivot lever 19 to the second transfer portion 9 is effected in conformity with the illustration of FIG. 2. An analogous coupling as illustrated in FIGS. 6 and 7 can also be expedient. As part of the speed regulator 7 (FIG. 3), the pivot lever 19 exclusively carries out a pivoting movement, which simplifies sealing of the regulation chamber 22 relative to the atmosphere in the region of the pivot axis 20.

If the speed regulator 7 is disposed in the tool gear mechanism 26 of FIG. 1, it has a comparable construction to that shown in FIGS. 3 to 5.

A further embodiment of the invention is shown in FIGS. 6 and 7. Shown of the internal combustion engine of the motor unit 1 (FIG. 1), which is not shown in greater detail and is embodied as a two-cycle engine, is only the region of a crankshaft 28, which is rotatably mounted in a crankcase 27, which is not illustrated separately. The rotatable mounting of the crankshaft 28 is effected by two crankshaft bearings 30 that are embodied as ball bearings and have an axis of rotation 21. Between the two crankshaft bearings 30, the crankshaft 28 is provided with two crank webs 29 that are spaced apart in the axial direction and between which is disposed a crankpin 50 that is disposed eccentrically relative to the axis of rotation 21. Engaging the crankpin 50 is a non-illustrated connecting rod of a similarly not illustrated piston. A one-cylinder construction having only one crankpin 50 is provided.

In the embodiment of FIGS. 6 and 7, an outer end 52 of the crankshaft 28 is provided with a thread by means of which a non-illustrated centrifugal clutch is threaded on and driven. The centrifugal clutch forms a drive means of the internal combustion engine, from which the engine output, after a prescribed speed, is transferred to the tool unit 2 (FIG. 1) via the transfer shaft 24 (FIG. 3). In the illustrated embodiment, the speed regulator 7 is disposed on the crankshaft 28 within the crankcase 27. In this connection, the crankshaft 28 serves as the regulating shaft 16. In the axial direction of the crankshaft 28, the speed regulator 7 is disposed axially beyond the associated crank web 29 between the centrifugal clutch and the crankshaft bearing 30 associated with the centrifugal clutch. This region of the crankcase 27 serves as the regulation chamber 22 and is subjected to the influence of the loss lubrication due to the oil-containing fuel/air mixture of the internal combustion engine. This advances through the open portions of the penetrable crankshaft bearing 30 to the speed regulator 7, and serves as lubricant for the latter. However, it can also be expedient to provide an independently lubricated regulation chamber 22 that is separate from the crankcase 27. Pursuant to an advantageous alternative, although the regulation chamber 22 and the crankcase 27 are spatially separated from one another, they are nonetheless in fluidic connection with one another via suitable bores or the like, so that the lost lubrication in the crankcase 27 can also reach the regulation chamber 22.

The function and construction of the speed or centrifugal regulator 7 essentially corresponds to the speed regulator 7 of FIGS. 3 to 5: two centrifugal weights 17 that are mounted so as to be pivotable about pivot axes 49 act upon a regulating sleeve 18 that is axially displaceable on the regulating shaft 16, i.e. the crankshaft 28. An inner lever arm 32 of the pivot lever 19 rests against that end face of the regulating sleeve 18 that faces the crankshaft bearing 30 or crank web 29. The pivot axis 20 of the pivot lever 19 extends at right angles to the axis of rotation 21, and is offset downwardly relative to the carburetor side of the internal combustion engine. The pivot axis or shaft 20 is guided out of the crankcase 27 through a seal 51 in a non-illustrated wall of the crankcase, and on the rear, outer side of the internal combustion engine merges into an outer lever arm 31 that is angled off at right angles and extends essentially parallel to the axis of rotation 21. The remaining features and reference numerals of the arrangement of the speed regulator 7 of FIG. 6 correspond to those of the speed regulator of FIGS. 3 to 5.

From the illustration of FIG. 6, it can be seen that the coupling device illustrated schematically in FIG. 2 is disposed on the shaft 40 of the butterfly valve 4. To facilitate illustration, the further components of the carburetor 3 (FIGS. 2, 7) are not illustrated in FIG. 6.

Relative to the axial direction of the butterfly valve 40, the coupling lever 15 for the engagement of the first transfer portion 8 is disposed on one side of the butterfly valve 4, and the actuating lever 13 is disposed on the opposite side of the butterfly valve 4. The second transfer portion 9 includes a pivotable coupling shaft 14, which in the illustrated embodiment is formed by the butterfly valve shaft 40 that carries the butterfly valve 4.

The coupling lever 15 forms a butterfly valve lever 41, and is pivotably mounted on the coupling shaft 14. A spring lever 53 is threaded on the associated outer end of the coupling shaft 14 so as to be fixed against rotation relative thereto. The spring device 12 is embodied as a helical torsion spring, and is wound around the coupling shaft 14 between the coupling lever 15 and the spring lever 53. A respective end of the spring device 12 is attached to each of the aforementioned levers, resulting in an elastically resilient biased pivoting connection between the coupling lever 15 and the spring lever 53. The coupling lever 15, which forms the butterfly valve lever 41, is connected with the actuating lever 13 in a torsionally elastic manner via the spring device 12, the spring lever 53 and the coupling shaft 14. Furthermore provided is a return spring 42, which is also embodied as a helical torsion spring and which acts upon the butterfly valve lever 41, i.e. the coupling lever 15. There thus results the same manner of operation of a coupling device as described in conformity with the schematic illustration of FIG. 2.

The speed regulator 7 acts upon the actuating lever 13 via the lever arm 31 and a connecting rod 33 that is attached to the outer end thereof. For this purpose, the connecting rod 33 is connected to the outer end of the lever arm 31 in a pivotable and free of play manner; at the opposite end, the connecting rod 33 is suspended in a slot 34 of the actuating lever 13. The slot 34 permits a dead travel of the speed regulator 7 without influencing the position of the butterfly valve 4. During normal operation, the butterfly valve 4 can be opened or closed by the first transfer portion 8 without a significant increase of the actuating forces taking place by means of the speed regulator 7.

In conformity with the illustration of FIG. 6, the connecting rod 33 is disposed in the slot 34 in such a way that the transfer of pulling forces, and not pushing forces, is possible. This permits a free closing of the butterfly valve 4 by means of the butterfly valve lever 41 and of the first transfer portion 8 that engages thereon. In the pulling direction, the connecting rods 33 rest in a manner free of play against the associated end of the slot 34, as a result of which the speed regulator 7, relative to the closing direction 10 (FIG. 2) of the butterfly valve 4, is connected essentially rigidly with the butterfly valve 4 via the second transfer portion 9.

FIG. 7 shows an end view of the arrangement of FIG. 6. Here one can see that the lever arm 31 of the pivot lever 19, which lever arm is disposed externally of the crankcase 27, is guided essentially parallel to the crankshaft 28 and, proceeding from the pivot axis 20, axially inwardly in a direction toward the center of the crankshaft 28 to beyond the crankpin 50 and the two crank webs 29. The lever arm 31 thus extends below the carburetor 3. From there, the connecting rod 33 is guided essentially vertically upwardly to the actuating lever 13. The free end of the lever arm 31, the connecting rod 33, and the actuating lever 13, in a compact construction and relative to the axial direction of the butterfly valve shaft 40, are thus disposed on a side of the carburetor 3 that is opposite to the butterfly valve lever 41.

Figure 8:
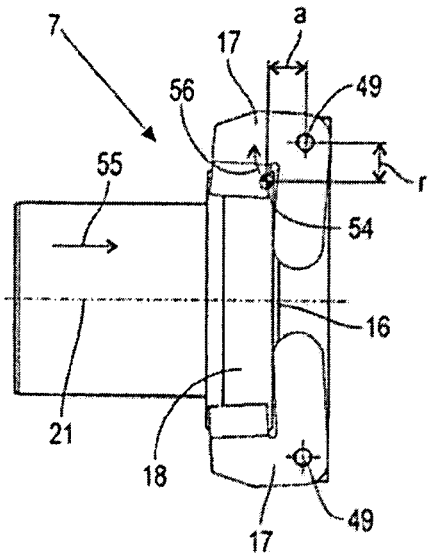
FIG. 8 is a side view of the speed regulator of FIGS. 3 to 7 in a position of rest, with details regarding the position of the mass center of the centrifugal weights.

FIG. 8 shows a side view of the speed regulator 7 of FIGS. 3 to 7 in a position of rest. The entire speed regulator 7 is rotatably driven about the axis of rotation 21 during operation. Due to the biasing of the spring device 12 (FIG. 2), the regulating sleeve 18 is pressed toward the two centrifugal weights 17 in a direction of the arrow 55 relative to the regulating shaft 16, and rests against a non-illustrated abutment in the axial direction in the direction of the arrow 55.

In the side view, the two centrifugal weights 17 have an L-shaped contour, and radially inwardly disposed legs thereof rest against an end face of the regulating sleeve 18. Radially outwardly disposed legs of the centrifugal weight 17, which are angled off at approximately right angles, extend over a portion of the regulating sleeve 18 approximately axis parallel to the axis of rotation 21. The pivot axes 49 of the two centrifugal weights 17 are disposed in the radially outer region of the speed regulator 7, and radially beyond the regulating sleeve 18. In this connection, the two pivot axes 49 extend tangentially relative to the axis of rotation 21. An arrangement where the pivot axes 49 extend parallel to the axis of rotation 21 can also be expedient.

The result of the L-shape of the centrifugal weights 17 and of the position of the two pivot axes 49 is that a mass center 54 of a respective individual centrifugal weight 17, relative to the axis of rotation 21, is disposed radially inwardly at a radial distance r from the respectively associated pivot axis 49. In the axial direction, counter to the arrow 55, the respective mass center 54 is disposed at an axial distance a relative to the associated pivot axis 49.

Upon rotation of the illustrated speed regulator 7, centrifugal forces act on the respective mass center 54 of the centrifugal weights 17; the centrifugal forces are directed radially outwardly relative to the axis of rotation 21, and in this connection have a lever arm relative to the pivot axis 49 in the magnitude of the axial distance a. The centrifugal force that respectively acts on a single centrifugal weight 17 increases quadratically with the speed and together with the axial distance a produces a pivot moment about the pivot axis 49 in the direction of the arrow 56.

Figure 9:
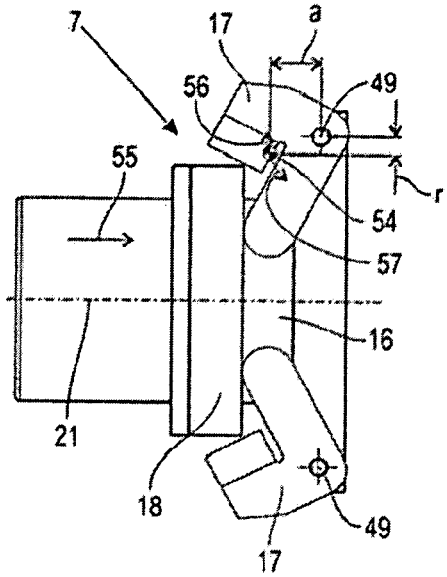
FIG. 9 shows the arrangement of FIG. 8 at increased speeds.

FIG. 9 shows the arrangement of FIG. 8 but at an increased speed, whereby the same features are provided with the same reference numerals. As a consequence of the centrifugal forces that act on the centrifugal weights 17, and the thereby resulting pivot moment about the pivot axes 49 that acts in the direction of the arrow 56, the two centrifugal weights 17 are pivoted radially outwardly. The respective radially inwardly disposed legs of the two centrifugal weights 17 are pivoted by the same amount in the axial direction counter to the arrow 55 and have displaced the regulating sleeve 18 relative to the position of FIG. 8 counter to the arrow 55 and parallel to the axis of rotation 21.

In the illustrated deflected position of the centrifugal weights 17, the radial distance r is reduced relative to the position of rest of FIG. 8, and the axial distance a is increased relative to the position of rest of FIG. 8. As the speed continues to increase, the two centrifugal weights 17 pivot further outwardly in the direction of the arrow 56 against the biasing force of the spring device 12 (FIG. 2), whereby the axial distance a increases further and the radial distance r is reduced further. This pivoting movement in the direction of the arrow 56 is limited by a non-illustrated stop or abutment. In this connection, the abutment is configured in such a way that at the maximum pivot angle of the centrifugal weights 17, the respective mass center 54 still has a radial distance r inwardly relative to the axis of rotation 21 proceeding from the associated pivot axis 49. As the speed decreases, the spring device 12 (FIG. 2) pivots the centrifugal weights 17 counter to the arrow 56 in the direction of the arrow 57 back into the position of rest of FIG. 8.

Figure 10:
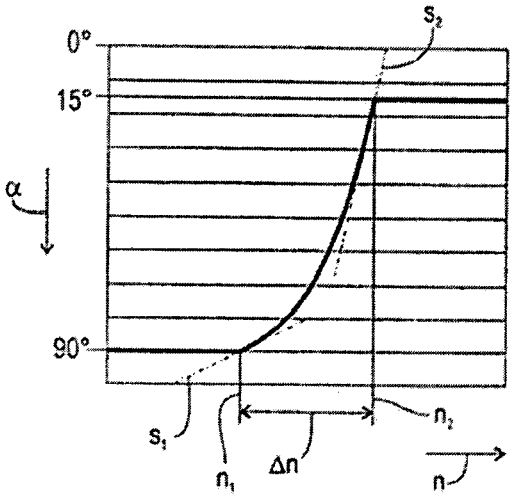
FIG. 10 shows a progressive speed curve of the speed regulator of FIGS. 3 to 9 to illustrate the butterfly valve angle as a function of the regulator speed.

FIG. 10 shows the characteristic curve of the mechanical speed regulator 7 of FIGS. 3 to 9. In conformity with the schematic illustration of FIG. 2, the speed regulator 7 is in operative connection with the butterfly valve 4 in such a way that the speed regulator 7, in conformity with the illustration of FIG. 10, effects a closing of the butterfly valve 4 (FIG. 2) as the speed n increases. In the fully opened state of the butterfly valve 4, it has a butterfly valve angle $\alpha=90°$ whereby it is disposed parallel to the intake channel in the carburetor 3 (FIG. 2). In the completely closed angular position of the butterfly valve 4 provided for idling, the butterfly valve, had a butterfly valve angle $\alpha=15°$, is disposed approximately perpendicular to the intake channel of the carburetor 3 (FIG. 2).

The characteristic curve of FIG. 10 describes the regulation characteristic of the speed regulator 7 of FIGS. 3 to 9 with the throttle 6 (FIG. 2) fully open. At low speeds, a butterfly valve angle $\alpha=90°$, is associated with this full throttle position in conformity with the characteristic curve of FIG. 10. In accordance with the illustration of FIG. 8, although a pivot moment acts upon the centrifugal weight 17 in the direction of the arrow 56, this pivot moment cannot overcome the biasing force of the spring device 12 (FIG. 2) in the direction of the arrow 55 (FIG. 8).

This biasing force is overcome only when a lower threshold speed $n_1$ is achieved or exceeded. The centrifugal weights 17 then begin to pivot outwardly in the direction of the arrow 56 (FIG. 8) and effect a closing of the butterfly valve 4 (FIG. 2). At the lower threshold speed $n_1$ the characteristic curve k, which represents the butterfly valve angle $\alpha$ as a function of the speed n of the centrifugal force or speed regulator 7, and hence of the drive motor, has a starting slope $s_1$.

As the speed increases, in conformity with the illustration of FIG. 9 the axial distance a also becomes greater, whereby the pivot moment about the pivot axis 49 progressively increases within a regulation range defined in FIG. 10 by $\Delta n$. The regulation range $\Delta n$ of the speed n is limited upwardly by an upper threshold speed $n_2$. At this point the centrifugal weights 17, in conformity with the description of FIG. 9, are disposed in the direction of the arrow 56 in their maximally pivoted position against an abutment. A further increase of the speed n effects no further pivoting of the centrifugal bodies or weights 17 in the direction of the anew 56 (FIG. 9). As a result of an increasing axial distance a, and of the centrifugal force that quadratically increases with the speed and that acts on the respective mass center 54, the regulation characteristic curve of FIG. 10 has a slope $s_2$ at the upper threshold speed $n_2$ that is greater than is the slope $s_1$ at the lower threshold speed $n_2$. Within the regulation range $\Delta n$, a progressive characteristic curve is provided between the slopes $s_1$ and $s_2$ where the slope becomes greater as the speed n increases.

The coupling between the speed regulator 7 (FIGS. 3 to 9) with the butterfly valve 4 (FIG. 2) is selected such that the butterfly valve angle $\alpha$ in conformity with the illustration of FIG. 10 is 90° at the lower threshold speed $n_1$ and 15° at the upper threshold speed $n_2$. With the throttle 6 (FIG. 2) fully open, the speed regulator 7 (FIGS. 3 to 9) acts upon the butterfly valve 4 over its entire adjustment range of full throttle ($\alpha=90°$) to idling ($\alpha=15°$). The butterfly valve angle for the idling position, here denoted with the $\alpha=15°$, is given by way of example only. A carburetor arrangement with a different butterfly valve angle $\alpha$ for the idling position can also be provided.

At low speeds, in the range of the lower threshold speed $n_1$, the progressive characteristic curve illustrated in FIG. 10 effects a smooth speed regulation, while with an operation in the high speed range near the upper threshold speed $n_2$, the butterfly valve is reliably closed as a consequence of the pronounced slope $s_2$ and thereby the speed n is reliably limited or regulated.

The specification incorporates by reference the disclosure of German priority document DE 10 2006 031 695.9 filed 08 Jul. 2006.

The present invention is, of course, in no way restricted to the specific disclosure of the specification and drawings, but also encompasses any modifications within the scope of the appended claims.

We claim:

1. A manually guided implement having a motor unit (1) that includes an internal combustion engine having a carburetor (3), wherein a butterfly valve (4) is disposed in said carburetor for controlling the power of the internal combustion engine, comprising:

a tool unit that is adapted to be driven by said motor unit (1);

a transfer mechanism (5) divided into a first transfer to portion (8) and a second transfer portion (9), wherein said second transfer portion is associated with said butterfly valve (4);

a throttle (6) that is associated with said first transfer portion (8) and is adapted to act upon said butterfly valve (4) via said transfer mechanism (5); and a mechanical speed regulator (7) for the internal combustion engine, wherein said speed regulator (7) is disposed between said first transfer portion (8) and said second transfer portion (9) such that said throttle (6), via said first transfer portion (8), as well as said speed regulator (7) together act upon said second transfer portion (9), and wherein said speed regulator (7), as its speed increases, is adapted to effect a closing of said butterfly valve (4).

2. An implement according to claim 1, wherein said speed regulator (7) is a speed limiter that above a prescribed threshold speed is adapted to effect a closing of said butterfly valve (4).

3. An implement according to claim 1, wherein said speed regulator (7), at least relative to a closing direction (10) of said butterfly valve (4), is connected essentially rigidly with said butterfly valve (4) via said second transfer portion (9), wherein an in particular biased elastic spring device (12) is provided, and wherein said throttle (6), together with said associated first transfer portion (8), are coupled to said to second transfer portion (9) via said spring device (12).

4. An implement according to claim 3, wherein said second transfer portion (9) engages a pivotable coupling shaft (14) on which said speed regulator (7) engages, wherein said first transfer portion (8) includes a coupling lever (15) that is pivotably mounted on said coupling shaft (14), and wherein said coupling shaft (14) and said coupling lever (15) are connected to one another in a pivot direction by means of said spring device (12), which is in particular embodied as a torsion spring.

5. An implement according to claim 3, wherein said throttle (6) is provided with a return spring (42), and wherein said return spring is stiffer than is said spring device (12).

6. An implement according to claim 1, wherein said spring regulator (7) includes a regulating shaft (16) that is driven by said internal combustion engine, wherein said regulating shaft (16) is provided with at least one, and in particular two, oppositely disposed centrifugal weights (17), wherein means are provided for producing an axial regulation movement, and wherein said at least one centrifugal weight (17) is mounted so as to be pivotable in a radial direction and to act upon said means for producing an axial regulation movement.

7. An implement according to claim 6, wherein said at least one centrifugal weight (17) is mounted so as to be pivotable about a pivot axis (49) disposed in particular tangential relative to an axis of rotation (21) of said regulating shaft (16), and wherein said centrifugal weight (17) has a mass center (54) that is disposed within a regulation range radially inwardly of said pivot axis.

8. An implement according to claim 6, wherein said means for producing an axial regulation movement is formed by an axially displaceable regulating sleeve (18) that is disposed on said regulating shaft (16).

9. An implement according to claim 6, wherein a pivot lever (19) is provided, wherein said means for producing an axial regulation movement acts upon said pivot lever (19), and wherein a pivot axis (20) of said pivot lever (19) is disposed essentially perpendicular to an axis of rotation (21) of said regulating shaft (16).

10. An implement according to claim 9, wherein said arrangement comprised of said at least one centrifugal weight (17) and said means for producing an axial regulation movement is disposed in an enclosed regulation chamber (22) that is in particular provided with a lubricant, and wherein said pivot lever (19) is guided out of said regulation chamber (22) in the vicinity of said pivot axis (20) of said pivot lever (19) and on the outside acts upon second transfer portion (9).

11. An implement according to claim 1, wherein said speed regulator (7) is disposed in said tool unit (2).

12. An implement according to claim 11, wherein a point of connection is provided in said tool unit (2) between said first and second transfer portions (8, 9).

13. An implement according to claim 11, wherein at least one of said motor unit (1) and said tool unit (2) is provided for a modular exchange.

14. An implement according to claim 11, wherein said tool unit (2) is provided with a tool gear mechanism (26), and wherein said speed regulator (7) is disposed in said tool gear mechanism (26).

15. An implement according to claim 11, wherein said tool unit (2) is provided with a supporting housing (25) and a tool gear mechanism (26), wherein a guide tube (23) having a transfer shaft (24) extending therein is disposed between said motor unit (1) and said tool unit (2), wherein said transfer shaft (24) is guided through said supporting housing (25) of said tool unit (2) to said tool gear mechanism (26), and wherein said speed regulator (7) is driven by said transfer shaft (24) and is disposed in said supporting housing (25) of said tool unit (2).

16. An implement according to claim 1, wherein said speed regulator (7) is disposed within a crankcase (27) on a crankshaft (28) of said internal combustion engine, which is embodied in particular as a loss-lubricated and preferably two-cycle engine.

17. An implement according to claim 16, wherein said speed regulator (7), in an axial direction of said crankshaft (28), is disposed between a crank web (29), in particular between a crankshaft bearing (30) disposed beyond said crank web (29), and a centrifugal clutch that is adapted to be disposed on said crankshaft (28).

18. An implement according to claim 16, wherein said speed regulator (7) is adapted to be lubricated by a fuel/air mixture disposed in said crankcase (27), in particular through a crankshaft bearing (30).

19. An implement according to claim 16, wherein a pivot lever (19) is provided having a lever arm (31) disposed outwardly of said crankcase (27), and wherein said lever arm (31) is guided essentially parallel to said crankshaft (28) and inwardly in a direction toward a center of said crankshaft (28) and below said carburetor (3).

20. An implement according to claim 19, wherein said pivot lever (19) is connected with an actuating lever (13) of a coupling shaft (14) via a connecting rod (33), and wherein said pivot lever (19) is suspended in a slot (34) of said actuating lever (13).

21. An implement according to claim 20, wherein said coupling shaft (14) is formed by a shaft (40) that supports said butterfly valve (4).

22. An implement according to claim 21, wherein said first transfer portion (8) includes a coupling shaft (15), and wherein said coupling shaft (15), for engagement of said first transfer portion (8), and said actuating lever (13), for engagement of said speed regulator (7), are disposed on opposite sides of said carburetor (3) relative to an axial direction of said shaft (40) of said butterfly valve (4).

* * * * *